US007687772B2

(12) United States Patent
Shiea

(10) Patent No.: US 7,687,772 B2
(45) Date of Patent: Mar. 30, 2010

(54) MASS SPECTROMETRIC IMAGING METHOD UNDER AMBIENT CONDITIONS USING ELECTROSPRAY-ASSISTED LASER DESORPTION IONIZATION MASS SPECTROMETRY

(75) Inventor: Jentaie Shiea, Koahsiung (TW)

(73) Assignee: National Sun Yat-Sen University, Koahsiung (TW)

( * ) Notice: Subject to any disclaimer, the term of this patent is extended or adjusted under 35 U.S.C. 154(b) by 249 days.

(21) Appl. No.: 11/780,055

(22) Filed: Jul. 19, 2007

(65) Prior Publication Data

US 2008/0006770 A1 Jan. 10, 2008

Related U.S. Application Data

(63) Continuation-in-part of application No. 11/561,131, filed on Nov. 17, 2006.

(30) Foreign Application Priority Data

Jan. 27, 2006 (TW) ..... 95103439 A

(51) Int. Cl.
*H01J 49/10* (2006.01)

(52) U.S. Cl. ..... 250/288; 250/281; 250/282; 250/287

(58) Field of Classification Search ..... 250/281, 250/282, 288, 286, 287, 423 R, 424, 425, 250/423 P; 435/287.1, 287.2; 239/418
See application file for complete search history.

(56) References Cited

U.S. PATENT DOCUMENTS

| | | | | |
|---|---|---|---|---|
| 5,663,561 | A * | 9/1997 | Franzen et al. | 250/288 |
| 5,873,523 | A * | 2/1999 | Gomez et al. | 239/3 |
| 6,485,689 | B1 * | 11/2002 | Huang et al. | 422/83 |
| 6,838,663 | B2 * | 1/2005 | Coon et al. | 250/288 |
| 7,193,223 | B2 * | 3/2007 | Franzen | 250/425 |
| 2002/0127566 | A1 * | 9/2002 | Hirabayashi et al. | 435/6 |
| 2005/0274885 | A1 * | 12/2005 | Brown et al. | 250/288 |
| 2007/0176113 | A1 * | 8/2007 | Shiea et al. | 250/423 P |
| 2008/0116366 | A1 * | 5/2008 | Shiea et al. | 250/282 |
| 2008/0149822 | A1 * | 6/2008 | Vertes et al. | 250/282 |
| 2008/0308722 | A1 * | 12/2008 | Shiea | 250/281 |

* cited by examiner

*Primary Examiner*—David A Vanore
*Assistant Examiner*—Michael Maskell
(74) *Attorney, Agent, or Firm*—Stephen A. Bent; Foley & Lardner LLP

(57) ABSTRACT

A mass spectrometric imaging method includes the steps of: forcing sequentially generated charge-laden liquid drops to move towards a receiving unit of a mass spectrometer along a traveling path; scanning a sample with a laser beam which has an irradiation energy sufficient to cause analytes contained in the sample to be desorbed to fly along a plurality of flying paths respectively; and positioning the sample relative to the laser beam to render the plurality of flying paths intersecting the traveling path so as to permit a plurality of the analytes respectively along the plurality of flying paths to be occluded in a plurality of the charge-laden liquid drops respectively to thereby form a plurality of corresponding ionized analytes.

8 Claims, 15 Drawing Sheets

MASS SPECTROMETRIC IMAGING METHOD UNDER AMBIENT CONDITIONS USING ELECTROSPRAY-ASSISTED LASER DESORPTION IONIZATION MASS SPECTROMETRY

CROSS-REFERENCE TO RELATED APPLICATION

This application is a continuation-in-part (CIP) of U.S. patent application Ser. No. 11/561,131, entitled "ELECTROSPRAY-ASSISTED LASER DESORPTION IONIZATION DEVICE, MASS SPECTROMETER, AND METHOD FOR MASS SPECTROMETRY", filed on Nov. 17, 2006, which claims priority from Taiwan 095103439 filed Jan. 27, 2006.

BACKGROUND OF THE INVENTION

1. Field of the Invention

The invention relates to molecular imaging, more particularly to mass spectrometric imaging under ambient conditions using electrospray-assisted laser desorption ionization mass spectrometry.

2. Description of the Related Art

Imaging mass spectrometry (IMS) is widely used in the investigation of chemical or molecular distributions of solid samples, such as metals, polymers, semiconductors, and geological substances.

Many attempts have been made to explore the feasibility of using imaging mass spectrometry in studying spatial distribution of proteins in various organs. However, due to the biological nature of target protein, e.g., being more labile to ionization energy and being in a state of flux, such efforts did not prove to be satisfactory.

One of the currently-used methods of imaging mass spectrometry is the secondary ion mass spectrometry (SIMS). However, SIMS is only capable of detecting analytes such as metal ions or small organic molecules, and is unable to detect macromolecules such as peptide or proteins because the macromolecules are either spoiled during ionization or unable to be effectively desorbed from the surface of the sample.

Another currently-used imaging method is the method of matrix-assisted laser desorption ionization mass spectrometry (MALDI-MS). Although MALDI-MS is capable of successfully desorbing peptide or protein molecules from a solid biological sample, and the result thereof is used to distinguish abnormal or cancerous tissues from normal tissues, several drawbacks still exist for MALDI, such as involving a tedious preparation work and requiring to be conducted in vacuum, etc.

Yet another currently-used imaging method is the method of desorption electrospray ionization mass spectrometry (DESI-MS), which is capable of studying a variety of compounds falling within a wide range of molecular weights, and which is capable of performing direct protein mass spectrometric analysis on a freely moving tissue slice. However, there are several disadvantages involved in DESI-MS, including the difficulty in controlling the precision of striking electron-carrying spray droplets onto the tissue slice, and the inability in desorbing protein molecules from the tissue slice.

It can be seen from the above that a variety of difficulties and inconveniences are encountered when obtaining molecular images through the methods of mass spectrometry. Since spatial analytic information of proteins in organs or tissues is extremely important in medical and biotechnological fields, there exists a need for a mass spectrometric imaging method that is capable of conducting rapid, convenient, and accurate spatial analysis on solid biological samples.

SUMMARY OF THE INVENTION

Therefore, the object of the present invention is to provide a mass spectrometric imaging method that can be conducted under ambient conditions, and that can be used to obtain an imaging profile of a sample that has a self-sustained shape with speed and accuracy. A further object of the present invention is to provide a mass spectrometric imaging method that is capable of swiftly and un-obstructively maneuvering a sample to move relative to a desorption mechanism such that mass spectrometric results for substantially continuous areas of the sample can be obtained in a desirable short period of time.

Another object of the present invention is to provide a mass spectrometer for implementing the mass spectrometric imaging method.

According to one aspect of the present invention, there is provided a mass spectrometric imaging method includes the steps of: forcing sequentially generated charge-laden liquid drops to move towards a receiving unit of a mass spectrometer along a traveling path; scanning a sample with a laser beam which has an irradiation energy sufficient to cause analytes contained in the sample to be desorbed to fly along a plurality of flying paths respectively; and positioning the sample relative to the laser beam to render the plurality of flying paths intersecting the traveling path so as to permit a plurality of the analytes respectively along the plurality of flying paths to be occluded in a plurality of the charge-laden liquid drops respectively to thereby form a plurality of corresponding ionized analytes.

Preferably, the mass spectrometric imaging method further includes the steps of obtaining a plurality of mass spectra respectively for a plurality of scanned areas of the sample through analyzing the plurality of corresponding ionized analytes which respectively correspond to the plurality of scanned areas of the sample; selecting at least one representative mass-to-charge ratio (m/z) signal which may signify a characteristic of the sample from the plurality of mass spectra; and constructing an imaging profile for the sample based on intensities at each of the at least one representative mass-to-charge ratio signal displayed by the plurality of scanned areas.

According to another aspect of the present invention, there is provided a mass spectrometric system which is capable of obtaining an imaging profile, and which includes a mass spectrometer for analyzing ionized analytes. The mass spectrometric system includes: a receiving unit for the mass spectrometer; means for forcing sequentially generated charge-laden liquid drops to move towards the receiving unit along a traveling path; means for scanning a sample with a laser beam which has an irradiation energy sufficient to cause analytes contained in the sample to be desorbed to fly along a plurality of flying paths respectively; and means for positioning the sample relative to the laser beam to render the plurality of flying paths intersecting the traveling path so as to permit a plurality of the analytes respectively along the plurality of flying paths to be occluded in a plurality of the charge-laden liquid drops respectively to thereby form a plurality of corresponding ionized analytes

BRIEF DESCRIPTION OF THE DRAWINGS

Other features and advantages of the present invention will become apparent in the following detailed description of the preferred embodiment with reference to the accompanying drawings, of which:

FIGS. 4(*b*)~(*h*) illustrate molecular imaging profiles constructed for the glossy ganoderma slice in exemplary example 1;

FIGS. 7(*b*)~(*d*) illustrate three mass spectra of the antrodia camphorata slice obtained at various scanned areas thereof in exemplary example 2;

FIGS. 8(*b*)~(*x*) illustrate molecular imaging profiles constructed for the antrodia camphorata slice in exemplary example 2;

FIGS. 10(*b*)~(*n*) illustrate molecular imaging profiles constructed for the angelica sinensis diels slices in exemplary example 3;

FIGS. 12(*b*)~(*e*) illustrate four mass spectra of the chicken brain slice obtained at various scanned areas thereof in exemplary example 4;

FIGS. 13(*b*)~(*h*) illustrate molecular imaging profiles constructed for the chicken brain slice in exemplary example 4;

FIGS. 16(*b*)-(*l*) illustrates molecular imaging profiles constructed for the chicken heart slice in exemplary example 5;

DETAILED DESCRIPTION OF THE PREFERRED EMBODIMENT

Figure 1:
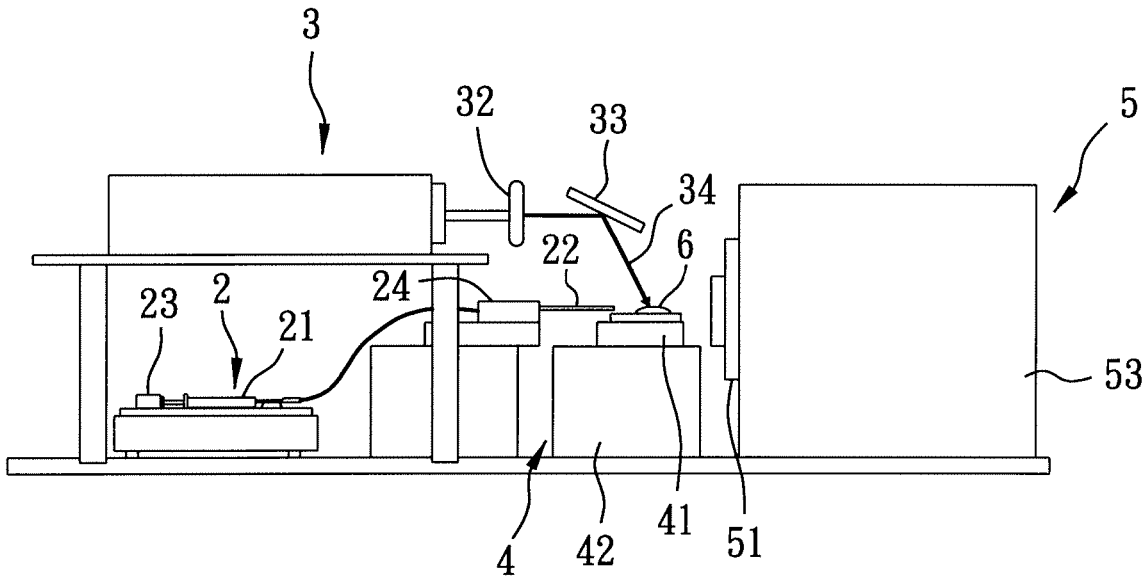
FIG. 1 is a schematic diagram of a mass spectrometric system for implementing the preferred embodiment of a mass spectrometric imaging method under ambient conditions using electrospray-assisted laser desorption ionization mass spectrometry (ELDI-MS) according to the present invention.

Referring to FIG. 1, a mass spectrometric system is used to implement the preferred embodiment of a mass spectrometric imaging method under ambient conditions using electrospray-assisted laser desorption ionization mass spectrometry (ELDI-MS) according to the present invention. The mass spectrometric system includes an electrospray unit 2, a laser desorption unit 3, a sample stage unit 4, a receiving unit 5, and an imaging processing software (not shown).

Figure 2:
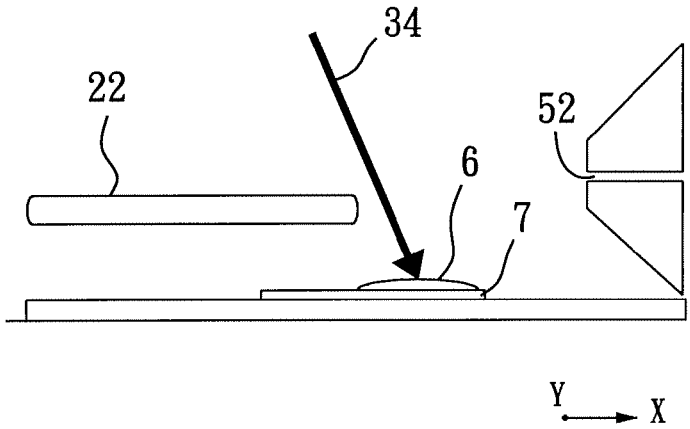
FIG. 2 is a fragmentary schematic view of the mass spectrometric system.

With further reference to FIG. 2, the electrospray unit 2 includes a reservoir 21 for accommodating a liquid electrospray medium, and a nozzle 22 which is disposed downstream of the reservoir 21, and which is configured to sequentially form liquid drops of the electrospray medium thereat for traveling along a traveling path. The electrospray unit 2 further includes a pump 23 disposed downstream of the reservoir 21 and upstream of the nozzle 22 for drawing the electrospray medium into the nozzle 22. The nozzle 21 is spaced apart from the receiving unit 5 in a longitudinal direction (X) so as to define the traveling path. In this embodiment, the electrospray unit 2 further includes a voltage supplying member 24 that is disposed to establish between the nozzle 22 and the receiving unit 5 a potential difference which is of an intensity such that the sequentially formed liquid drops are laden with a plurality of charges, and such that the charge-laden liquid drops are forced to leave the nozzle 22 for heading toward the receiving unit 5 along the traveling path. In this embodiment, the electrospray medium is an acidified methanol solution (50%). In addition, the charges laden in the liquid drops can be either univalent or multivalent.

The laser desorption unit 3 includes a laser transmission mechanism 31 that is capable of transmitting a laser beam 34, a lens 32 that is disposed to receive the laser beam 34 from the laser transmission mechanism 31 for focusing the energy carried by the laser beam 34, and a reflector 33 that is disposed to change the path of the laser beam 34. The laser desorption unit 3 is adapted to irradiate a sample 6 such that, upon irradiation, a plurality of analytes, such as chemical or biochemical molecules, contained in the sample 6 are desorbed to fly along a plurality of flying paths, respectively. In this embodiment, the laser transmission mechanism 31 is a nitrogen ($N_2$) gas laser (337 nm, 100 μJ, Q-switch).

The sample stage unit 4 includes a movable sample stage 41 and a computer-controlled positioning mechanism 42. The sample stage 41 is movable relative to the laser beam 34 such that a laser spot may be formed at a different location on the sample 6 for each laser pulse. The computer-controlled positioning mechanism 42 is connected electrically to the sample stage 41 for controlling movement of the sample stage 41 relative to the laser beam 34. In this embodiment, the sample stage 41 is movable in a plane along the longitudinal direction (X) and a transverse direction (Y) perpendicular to the longitudinal direction (X). It should be noted herein that the sample stage 41 can be movable in three dimensions in other embodiments of the present invention. It should be further noted that the sample stage 41 can also be made stationary, while the laser beam 34 irradiated by the laser desorption unit 3is made movable, in other embodiments of the present invention, as long as relative movement between the sample stage 41 and the laser beam 34 can be established.

The sample stage 41, along with the sample 6 placed thereon, is positioned relative to the laser beam 34 to render the plurality of flying paths of the analytes to intersect the traveling path of the charge-laden liquid drops so as to permit a plurality of the analytes respectively along the plurality of flying paths to be occluded in a plurality of the charge-laden liquid drops respectively to thereby form a plurality of corresponding ionized analytes. The ionized analytes are formed due to passing of the charges in the liquid drops onto the analytes as the charge-laden liquid drops dwindle in size when approaching the receiving unit 5 along the traveling path.

The receiving unit 5 includes a mass analyzer 51 formed with a conduit 52 that is in air communication with the environment, and a detector 53 for receiving signals generated by the mass analyzer 51. The mass analyzer 51 receives the ionized analytes through the conduit 52, separates the ionized analytes according to their m/z values (mass-to-charge ratios), and generates corresponding signals for the ionized analytes. Preferably, the mass analyzer 51 is selected from the group consisting of an ion trap mass analyzer, a quadrupole time-of-flight mass analyzer, a triple quadrupole mass analyzer, an ion trap time-of-flight mass analyzer, a time-of-flight/time-of-flight mass analyzer, and a Fourier transform ion cyclotron resonance (FTICR) mass analyzer.

Figure 3:
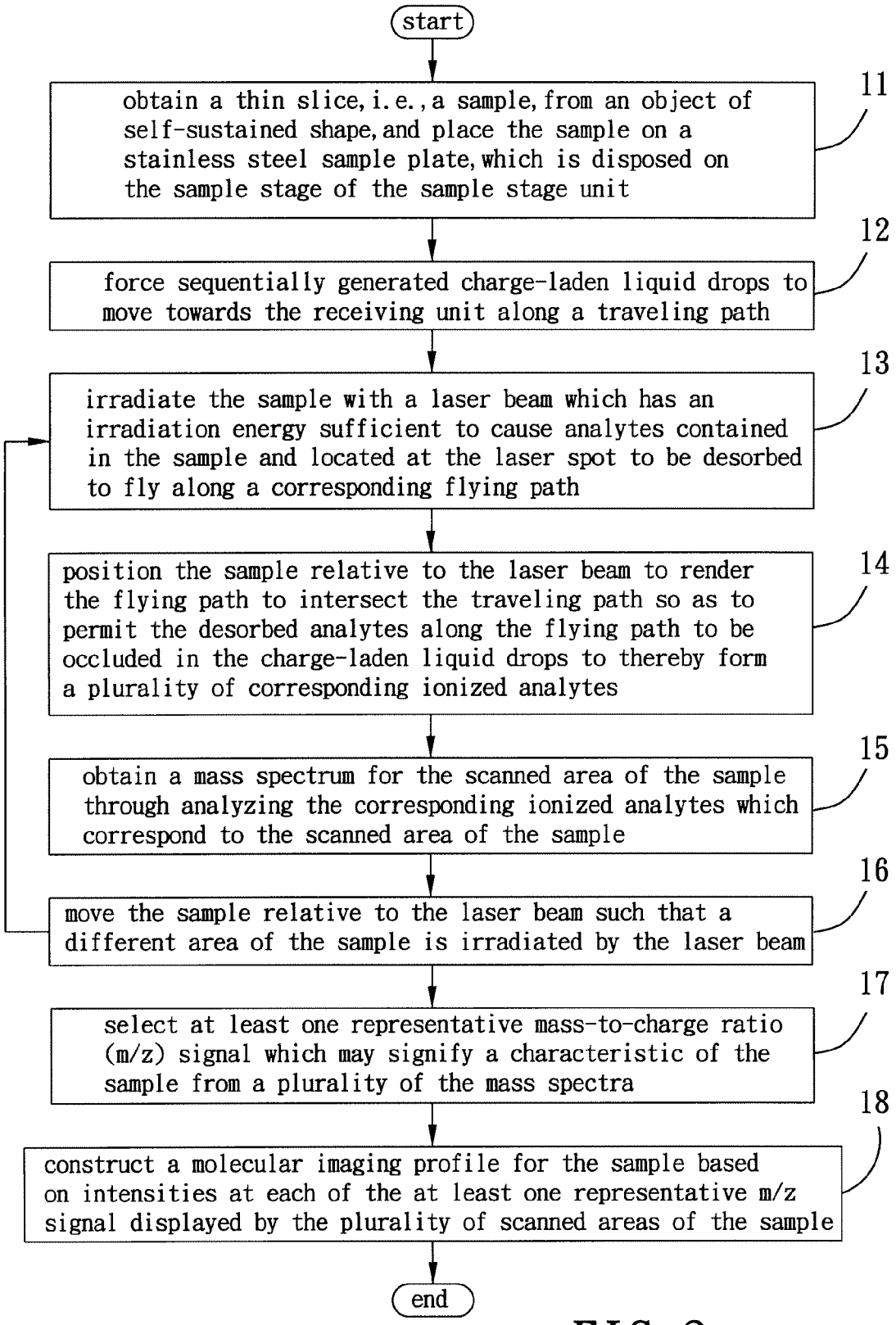
FIG. 3 is a flow chart of the preferred embodiment of the mass spectrometric imaging method.

With further reference to FIG. 3, the preferred embodiment of the mass spectrometric imaging method according to the present invention is performed in conjunction with the mass spectrometric system described above.

In step 11, an object of self-sustained shape is first cut into a thin slice, which is referred to as the sample 6, by a sharp razor blade or through the method of frozen section, and the sample 6 is then placed on a stainless steel sample plate 7, which is disposed on the sample stage 41 of the sample stage unit 4.

In step 12, sequentially generated charge-laden liquid drops are forced to move towards the receiving unit 5 along a traveling path. In this embodiment, the sequentially generated charge-laden liquid drops are formed by the electrospray unit 2 at the nozzle 21 thereof, and are forced to move towards the receiving unit 5 by the electrospray unit 2.

In step 13, the sample 6 is irradiated with the laser beam 34 which has an irradiation energy sufficient to cause analytes contained in the sample 6 and located at the laser spot to be desorbed to fly along a corresponding flying path. In this embodiment, the laser beam 34 is transmitted through a fiber optic unit.

In step 14, the sample 6 is positioned relative to the laser beam 34 to render the flying path to intersect the traveling path so as to permit the desorbed analytes along the flying path to be occluded in the charge-laden liquid drops to thereby form a plurality of corresponding ionized analytes.

In step 15, a mass spectrum is obtained for the scanned area of the sample 6 (i.e., the area where the laser spot is formed) through analyzing the corresponding ionized analytes which correspond to the scanned area of the sample 6.

In step 16, the sample 6 is moved relative to the laser beam 34 such that a different area of the sample 6 is irradiated by the laser beam 34.

Steps 14 to 16 are then repeated multiple times in a traceable manner. In other words, various areas of the sample 6 are irradiated by the laser beam 34 to generate corresponding ionized analytes, and to obtain corresponding mass spectra.

In this embodiment, the laser beam 34 is kept to irradiate along a predetermined line, and the sample stage 41 of the sample stage unit 4 is moved relative to the laser beam 34 in incremental steps in the longitudinal direction (X) and the transverse direction (Y) by control of the computer-controlled positioning mechanism 42, so as to position the sample 6 relative to the laser beam 34. For instance, for every increment in the longitudinal direction (X), the computer-controlled positioning mechanism 42 controls the sample stage 41 to move in incremental steps in the transverse direction (Y), such that various areas of the sample 6, which is placed on the sample stage 41, are sequentially irradiated by the laser beam 34. As a result, for each scanned area of the sample 6, analytes contained in the sample 6 at the scanned area are desorbed to fly along the corresponding flying path that is rendered to intersect the traveling path of the charge-laden liquid drops so as to form the corresponding ionized analytes, and a corresponding mass spectrum is then obtained through analyzing the corresponding ionized analytes which correspond to the scanned area of the sample 6.

Consequently, by the end of these repeated steps, a plurality of mass spectra are obtained respectively for the scanned areas of the sample 6 through analyzing the plurality of corresponding ionized analytes which respectively correspond to the scanned areas of the sample 6.

Preferably, the laser beam 34 forms a laser spot with an area of 100 μm×150 μm on the sample 6, and the laser transmission mechanism 31 has an operating frequency of between 5 Hz to 10 Hz. With a mass spectrum corresponding to each laser spot on the sample 6, i.e., corresponding to each scanned area of the sample 6, ideally approximately eighty-two hundred to sixteen thousand mass spectra are obtained for an area of 1 $cm^2$ on the sample 6.

In step 17, at least one representative mass-to-charge ratio (m/z) signal which may signify a characteristic of the sample 6 is selected from the plurality of mass spectra.

In step 18, a molecular imaging profile for the sample 6 is constructed based on intensities at each of the at least one representative m/z signal displayed by the plurality of scanned areas of the sample 6.

The present invention is described hereinafter in conjunction with a number of exemplary examples conducted to verify the mass spectrometric imaging under ambient conditions using electrospray-assisted laser desorption ionization mass spectrometry. It should be noted herein that the exemplary examples are for illustrative purposes only, and should not be taken as limitations imposed on the present invention.

Chemicals and Equipments Used

The exemplary examples are conducted using the following chemicals and equipments:

1. Laser Desorption Unit: The laser beams are transmitted by a pulse nitrogen laser, and has a wavelength of 337 nm, a pulse energy of 120 μJ, and an operating frequency of 10 Hz. The laser beams irradiate the sample 6 at a 45 degree incident angle, and forms a laser focused spot size of 100×150 $\mu m^2$ on the sample.
2. Mass Analyzer (including the Detector): Ion Trap Mass Analyzer model no. Esquire Plus 3000 plus, manufactured by Bruker Dalton company of Germany, where the mass analyzer is modified to include with a stainless steel tube with an inner diameter of 3 mm and a length of 50 mm that extends from the mass analyzer out of an entrance of the mass analyzer, and the mass spectra are obtained at a rate of one per second.

3. Electrospray Medium: an aqueous solution containing 0.1 vol % of acetic acid and 50 vol % of methanol at a flow rate of 120 μL per hour.
4. Matrix: α-cyano-4-hydroxycinnamic acid (α-CHC) (70% acetonitrile (ACN), 0.1% Trifluroacetic acid (TFA)), which is a HPLC matrix manufactured by Sigma-Aldrich company of the United States.
5. Sample Stage Unit: the sample stage is movable at a minimum moving rate of 0.02 cm/s.

EXEMPLARY EXAMPLE 1

Imaging Mass Spectrometric Analysis using Electrospray-assisted Laser Desorption Ionization Mass Spectrometry (ELDI-MS) on Glossy Ganoderma (Ganoderma Lucidum)

Figure 4:
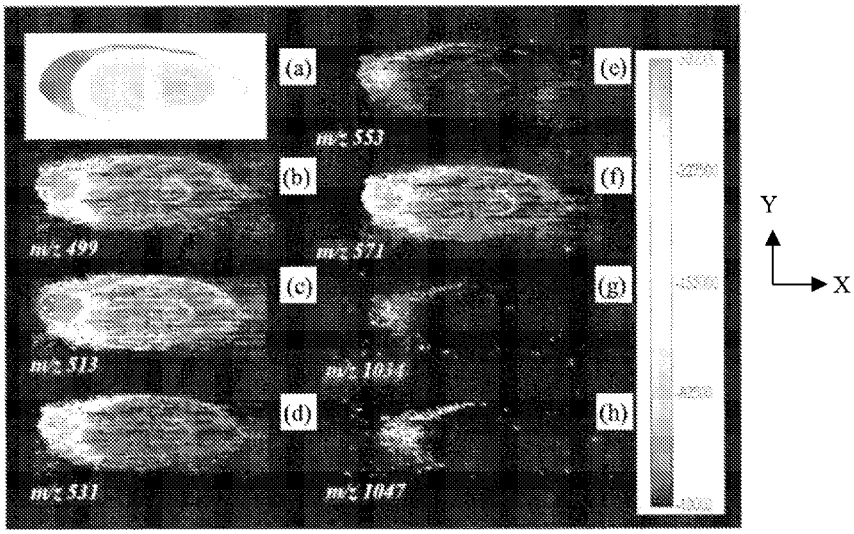
FIG. 4(*a*) illustrates a photograph of a glossy ganoderma slice obtained for conducting imaging mass spectrometric analysis in exemplary example 1.
Figure 5:
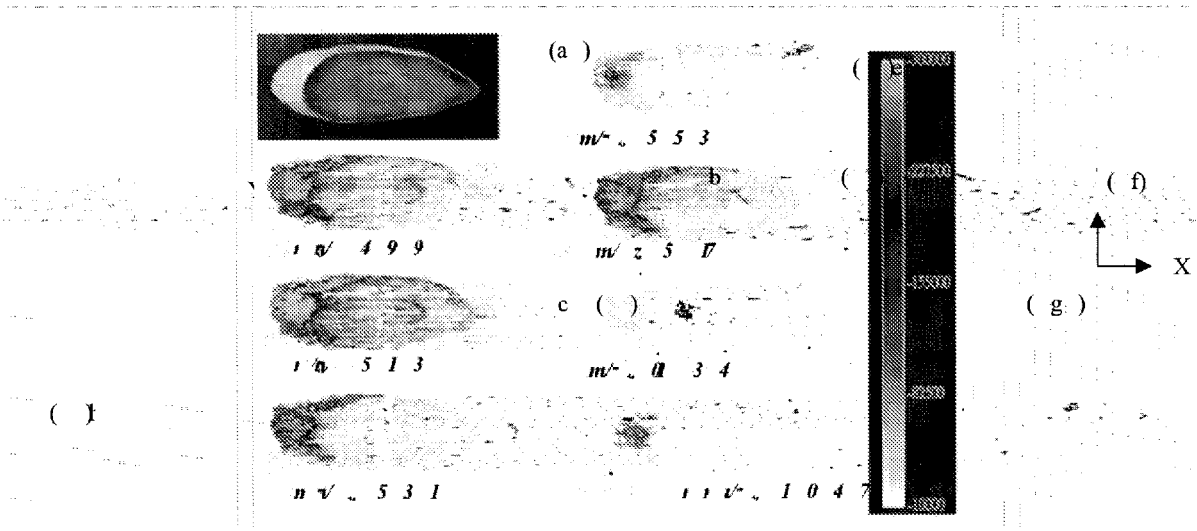
FIG. 5(*a*)~(*h*) illustrate negative images of FIGS. 4(*a*)~(*h*), respectively.

As shown in FIG. 4(*a*) and FIG. 5(*a*), a slice of glossy ganoderma, a genus of polypores, was obtained for exemplary example 1 using a razor blade, where FIG. 4(*a*) shows a photograph of the glossy ganoderma slice and FIG. 5(*a*) is a negative image of FIG. 4(*a*). The glossy ganoderma slice was measured 10 mm in length, 35 mm in width, and 3 mm in thickness. The glossy ganoderma slice was placed on the sample stage 41 of the sample stage unit 4 (refer to FIG. 1) to be irradiated by the laser beam 34 (refer to FIG. 1 and FIG. 2) for conducting imaging mass spectrometric analysis using ELDI-MS.

While the laser beam 34 irradiates the glossy ganoderma slice to form a laser spot of 100×150 $\mu m^2$ thereon at an operating frequency of 10 Hz, i.e., 10 laser shots per second, the sample stage 41 is moved relative to the laser beam 34 at the speed of 0.02 cm/sec in the longitudinal direction (X), such that two subsequent laser spots formed on the glossy ganoderma slice in the longitudinal direction (X) are spaced apart from each other for 0.02 mm. The sample stage 41 was further moved in the transverse direction (Y) in consecutive increments of ⅙ mm upon control by the computer-controlled positioning mechanism 42. In other words, the laser beam 34 scans across the glossy ganoderma slice in the longitudinal direction (X) for 60 times, each time at a different increment in the transverse direction (Y). In addition, since the mass spectra were obtained at a rate of one per second, each mass spectrum corresponds to an average of 10 corresponding successive laser spots that are formed on the glossy ganoderma slice and that are altogether referred to as a scanned area of the glossy ganoderma slice. Consequently, for each increment in the transverse direction (Y), 175 mass spectra were obtained. Moreover, a total of 10,500 mass spectra were obtained for the glossy ganoderma slice.

Figure 6:
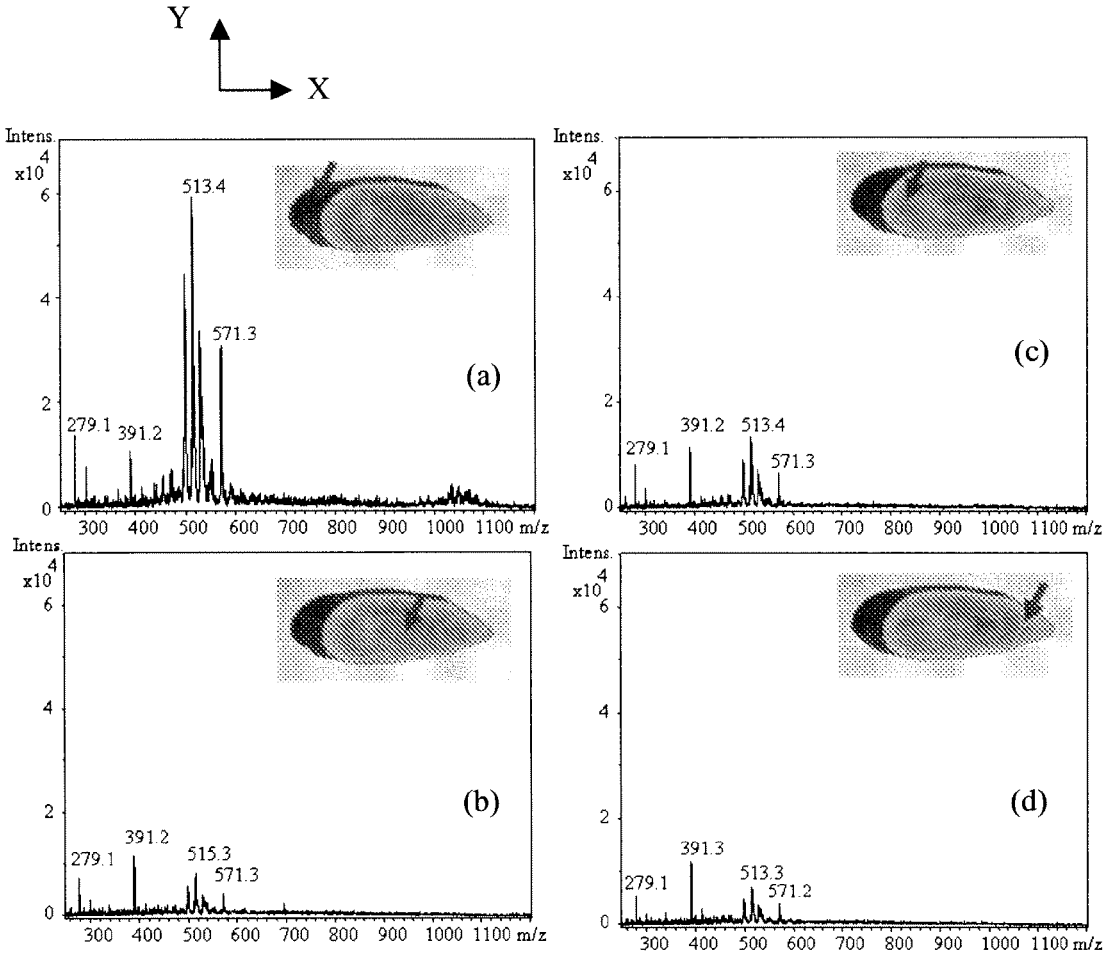
FIGS. 6(*a*)~(*d*) illustrate four mass spectra of the glossy ganoderma slice obtained at various scanned areas thereof in exemplary example 1.

Shown in FIGS. 6(*a*)~(*d*) are four mass spectra of the glossy ganoderma slice obtained at various scanned areas thereof. A photograph of the glossy ganoderma slice identical to that shown in FIG. 4(*a*) is illustrated on the top right hand corner of each of FIGS. 6(*a*)~(*d*). An arrow is provided for each of FIGS. 6(*a*)~(*d*) to indicate the particular scanned area of the glossy ganoderma slice that corresponds thereto.

A plurality of representative m/z signals were selected from the mass spectra obtained for the glossy ganoderma slice so as to characterize the glossy ganoderma slice, and include m/z=499, m/z=513, m/z=530, m/z=553, m/z=571, m/z=1034, m/z=1047.

With the representative m/z signals selected, the intensities at these representative m/z signals in all of the mass spectra, each of which corresponds to a different scanned area of the glossy ganoderma slice, were collected. Then, a molecular imaging profile is constructed for the glossy ganoderma slice at each of the representative m/z signals in the mass spectra using the computer software based on the intensities at the representative m/z signal in the mass spectra, i.e., the intensities at each of the representative m/z signals displayed by the scanned areas of the glossy ganoderma slice. Shown in FIGS. 4(*b*)~(*h*) are molecular imaging profiles of the glossy ganoderma slice constructed for exemplary example 1 at the representative m/z signals thus selected (i.e., at m/z=499, m/z=513, m/z=530, m/z=553, m/z=571, m/z=1034, m/z=1047), respectively. FIGS. 5(*b*)~(*h*) illustrate negative images of the molecular imaging profiles shown in FIGS. 4(*b*)~(*h*). From the molecular imaging profiles, various chemical compositions contained in the surface of the glossy ganoderma slice, and relative intensities and distributions thereof are clearly revealed.

EXEMPLARY EXAMPLE 2

Imaging Mass Spectrometric Analysis using ELDI-MS on Antrodia Camphorata

Figure 7:
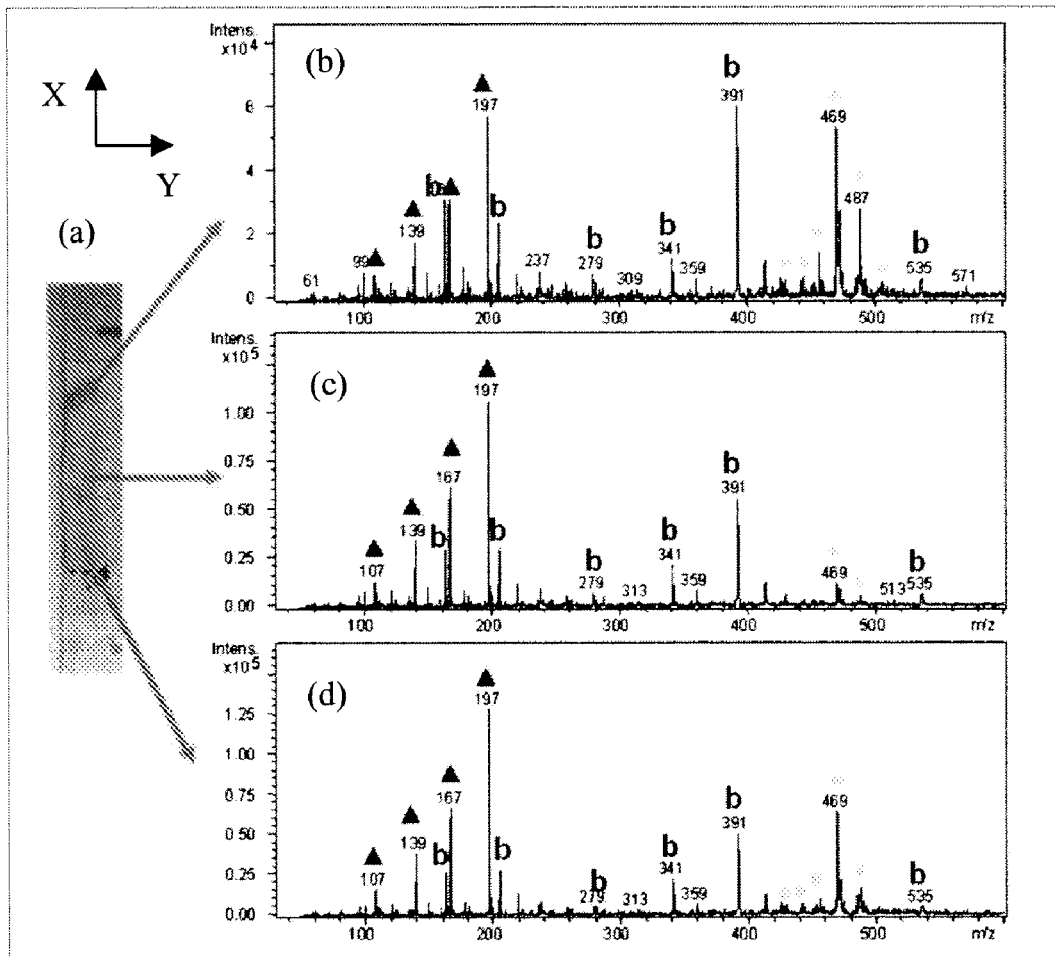
FIG. 7(*a*) is a photograph of an antrodia camphorata slice obtained for conducting imaging mass spectrometric analysis in exemplary example 2.

As shown in FIG. 7(*a*), a slice of antrodia camphorata, a special Taiwanese fungus species that only grows on cinnamomum kanehirae, was obtained for exemplary example 2 using a razor blade, where FIG. 7(*a*) shows a photograph of the antrodia camphorata slice. The antrodia camphorata slice was measured 21 mm in length, 3 mm in width, and 1 mm in thickness.

The sample stage 41 was moved relative to the laser beam 34 in the longitudinal direction (X) in the same manner as described above for exemplary example 1, such that two subsequent laser spots formed on the antrodia camphorata slice in the longitudinal direction (X) are spaced apart from each other for 0.02 mm. The sample stage 41 was further moved in the transverse direction (Y) in consecutive increments of 3/26 mm upon control by the computer-controlled positioning mechanism 42. In other words, the laser beam 34 scans across the antrodia camphorata slice in the longitudinal direction (X) for 26 times, each time at a different increment in the transverse direction (Y). In addition, since the mass spectra were obtained at a rate of one per second, each mass spectrum corresponds to an average of 10 corresponding successive laser spots that are formed on the antrodia camphorata slice and that are altogether referred to as a scanned area of the antrodia camphorata slice. Consequently, for each increment in the transverse direction (Y), 105 mass spectra were obtained. Moreover, a total of 2,730 mass spectra were obtained for the antrodia camphorata slice.

Shown in FIGS. 7(*b*)~(*d*) are three mass spectra of the antrodia camphorata slice obtained at various scanned areas thereof. A corresponding arrow is provided on FIG. 7(*a*) for each of FIGS. 7(*b*)~(*d*) to indicate the particular scanned area on the antrodia camphorata slice that corresponds to the corresponding mass spectrum. The mass spectra obtained for the antrodia camphorata slice indicate two ion peak groups. One of the ion peak groups is composed of volatile odorous smaller molecules, and includes, for instance, m/z=107, m/z=139, m/z=167 and m/z=197. The other one of the ion peak groups is composed of triterpenoid compounds, which are active functional ingredients contained in the antrodia camphorata slice, and includes, for examples m/z=425, m/z=439, m/z=441, m/z=453, m/z=469, m/z=471 and m/z=487, etc. These m/z values were selected to be the representative m/z signals for the antrodia camphorata slice in this exemplary example. With reference to information recorded in relevant databases, the m/z=469, m/z=483, m/z=485, m/z=487, m/z=489, m/z=501, and m/z=529 ion peaks correspond to chemical compounds with chemical formulae of $C_{31}H_{48}O_3$, $C_{31}H_{46}O_4$, $C_{30}H_{44}O_5$, $C_{29}H_{44}O_6$, $C_{31}H_{60}O_4$, $C_{30}H_{44}O_6$, $C_{33}H_{52}O_5$, respectively, and the m/z=471 ion peak corresponds to chemical compound with chemical formulae of $C_{30}H_{46}O_4$, $C_{31}H_{50}O_3$, $C_{29}H_{42}O_5$, which respectively correspond to molecular weights of 470.68 Da, 470.73 Da and 470.64 Da.

Figure 8:
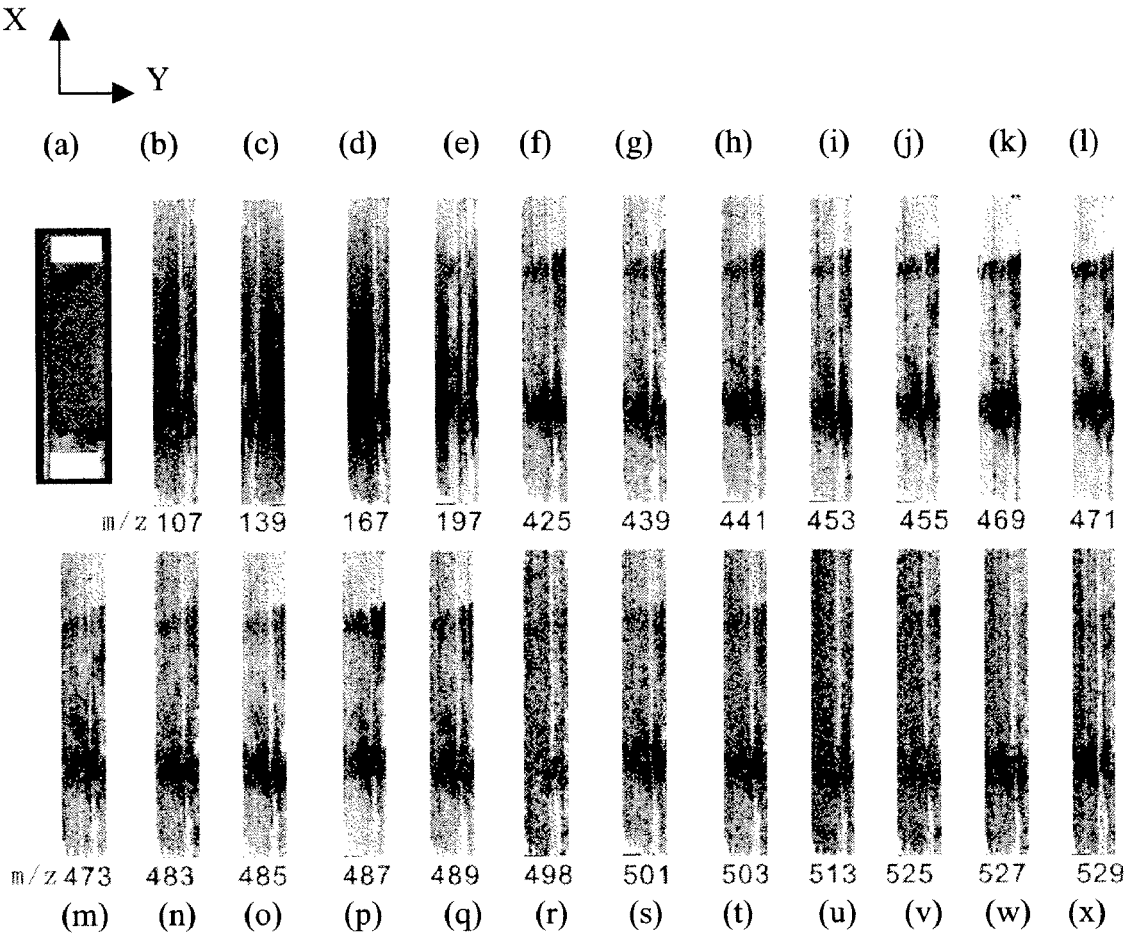
FIG. 8(*a*) is another photograph of the antrodia camphorata slice.

As shown in FIGS. 8(*b*)~(*x*), a plurality of molecular imaging profiles were constructed for the antrodia camphorata slice at each of the representative m/z signals. It is seen from FIGS. 8(*b*)~(*e*) that volatile ions are distributed relatively evenly throughout the surface of the antrodia camphorata slice. This is because volatile odorous ions are continuously emitted from the surface of the antrodia camphorata slice, which is a tissue surface. It is seen from FIGS. 8(*f*)~(*x*) that triterpenoid compounds concentrate more on ends of the antrodia camphorata slice (i.e., top and bottom ends of FIG. 8(*a*)) that correspond to an outer surface of the antrodia camphorata from which the slice was obtained, and less near the center of the antrodia camphorata slice that correspond to an inner portion of the antrodia camphorata from which the slice was obtained.

EXEMPLARY EXAMPLE 3

Figure 10:
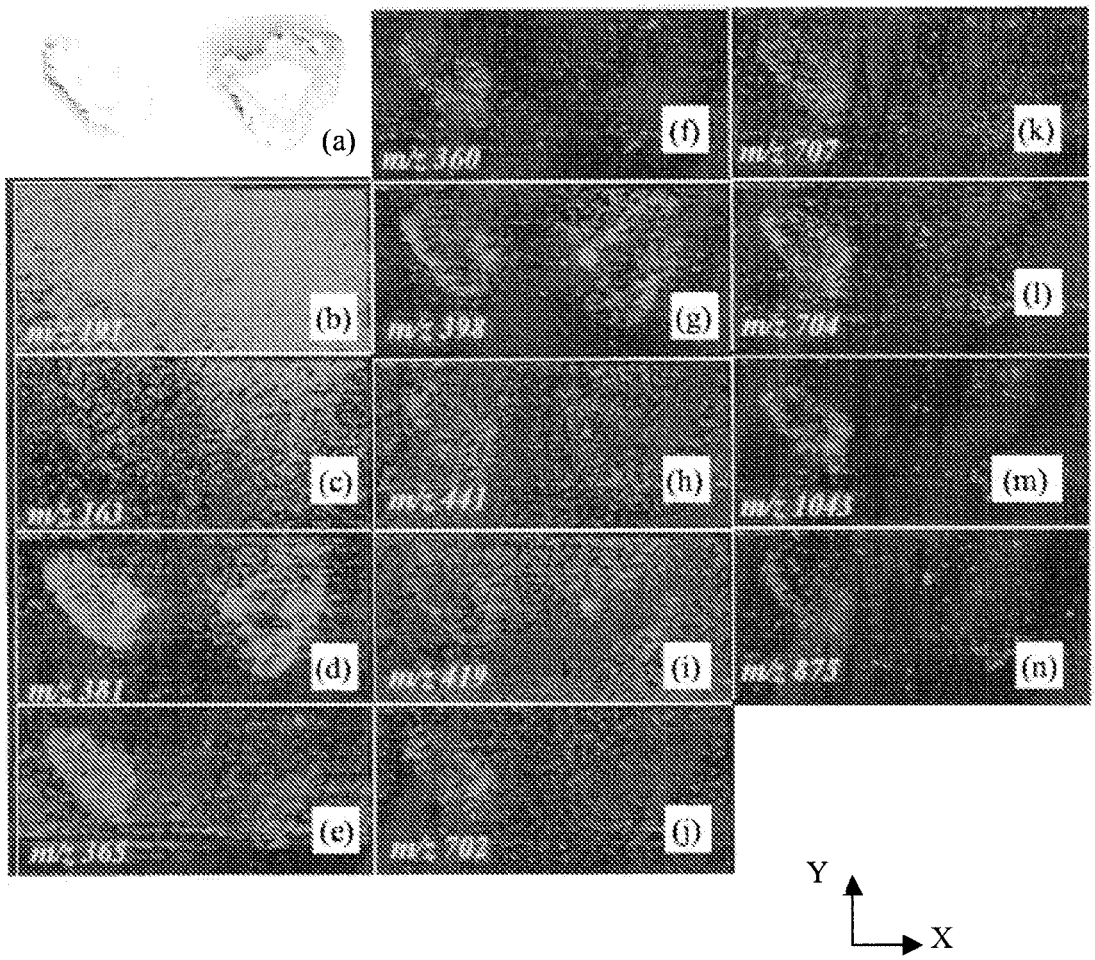
FIG. 10(*a*) illustrates a photograph of the angelica sinensis diels slices.
Figure 11:
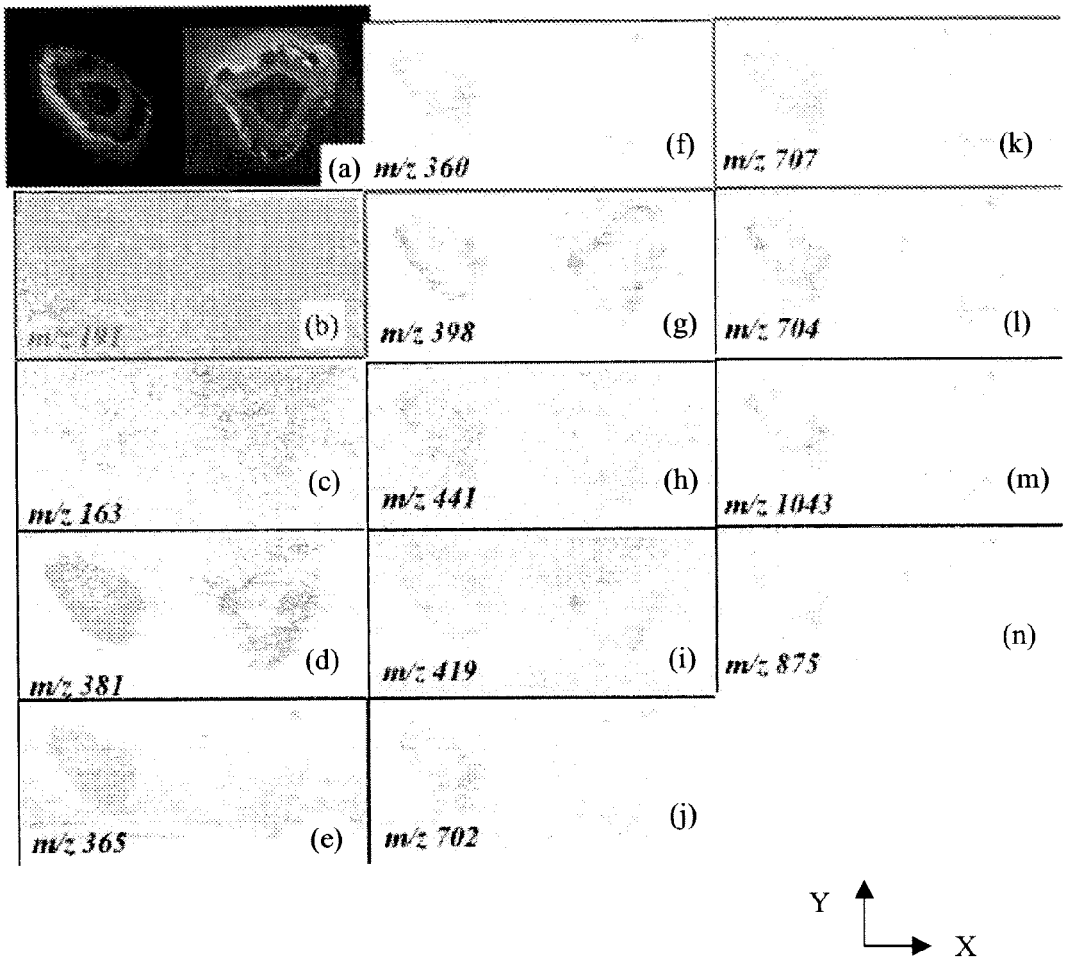
FIGS. 11(*a*)~(*n*) illustrate negative images of FIGS. 10(*a*)~(*n*), respectively.

Imaging Mass Spectrometric Analysis using ELDI-MS on Angelica Sinensis Diels As shown in FIG. 10(*a*) and FIG. 11(*a*), two slices of angelica sinensis diels, a traditional Chinese medicine, were obtained for exemplary example 3, where FIG. 10(*a*) shows a photograph of the angelica sinensis diels slices, and FIG. 11(*a*) shows a negative image of FIG. 10(*a*). The angelica sinensis diels slices were respectively measured 2 cm and 2 cm in length, 2 cm and 1 cm in width, and 2 mm and 2 mm in thickness.

The sample stage 41 was moved relative to the laser beam 34 in the longitudinal direction (X) in the same manner as described above for exemplary example 1, such that two subsequent laser spots formed on each of the angelica sinensis diels slices in the longitudinal direction (X) are spaced apart from each other for 0.02 mm. The sample stage 41 was further moved in the transverse direction (Y) in consecutive increments of 1/15 cm for analyzing the angelica sinensis diels slices simultaneously, upon control by the computer-controlled positioning mechanism 42. In other words, the laser beam 34 scans across the angelica sinensis diels slices in the longitudinal direction (X) for 30 times, each time at a different increment in the transverse direction (Y). In addition, since the mass spectra were obtained at a rate of one per second, each mass spectrum corresponds to an average of 10 corresponding successive laser spots that are formed on the angelica sinensis diels slices and that are altogether referred to as a scanned area of the angelica sinensis diels slices. Consequently, for each increment in the longitudinal direction (X), 200 mass spectra were obtained for the angelica sinensis diets slices. Moreover, a total of 6,000 mass spectra were obtained for the angelica sinensis diels slices.

Figure 9:
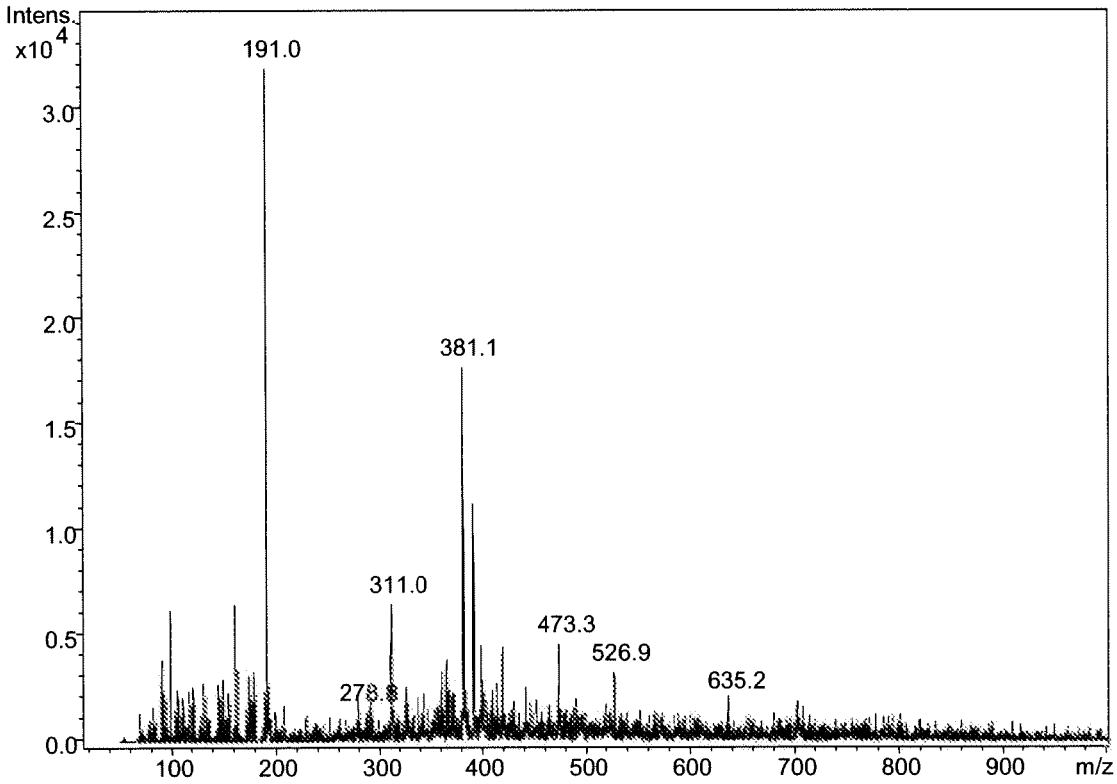
FIG. 9 illustrates a mass spectrum obtained for one of two angelica sinensis diels slices, which were obtained for conducting imaging mass spectrometric analysis in exemplary example 3.

Like antrodia camphorata, angelica sinensis diels has a relatively strong smell, indicating that angelica sinensis diels also contains volatile odorous chemical compositions. Shown in FIG. 9 is amass spectrum obtained for one of the angelica sinensis diels slices, from which two ion peak groups are found. One of the ion peak groups is composed of volatile odorous smaller molecules, and includes, for instance, m/z=163 and m/z=191. The other one of the ion peak groups is composed of higher molecular weight chemical components, and ranges approximately from m/z=350 to m/z=500, etc. These and some additional m/z values were selected to be the representative m/z signals for the angelica sinensis diels slices in this exemplary example.

As shown in FIGS. 10(*b*)~(*n*), a plurality of molecular imaging profiles were constructed for the angelica sinensis diels slices at each of the representative m/z signals. FIGS. 11(*b*)~(*n*) illustrate negative images of the molecular imaging profiles shown in FIGS. 10(*b*)~(*n*). From FIGS. 10(*b*)~(*c*), it is seen that the volatile odorous smaller molecular ions are distributed relatively evenly throughout the surface of the angelica sinensis diels slices, as the volatile odorous smaller molecular ions are continuously emitted from the surface of the angelica sinensis diels slices. From FIGS. 10(*d*)~(*n*), it is seen that the non-volatile ions concentrate more on outer peripheries of the angelica sinensis diels slices that correspond to an outer surface of the angelica sinensis diels from which the slices were obtained, and less near the center of the angelica sinensis diels slices that correspond to an inner portion of the angelica sinensis diels from which the slices were obtained.

EXEMPLARY EXAMPLE 4

Imaging Mass Spectrometric

Figure 12:
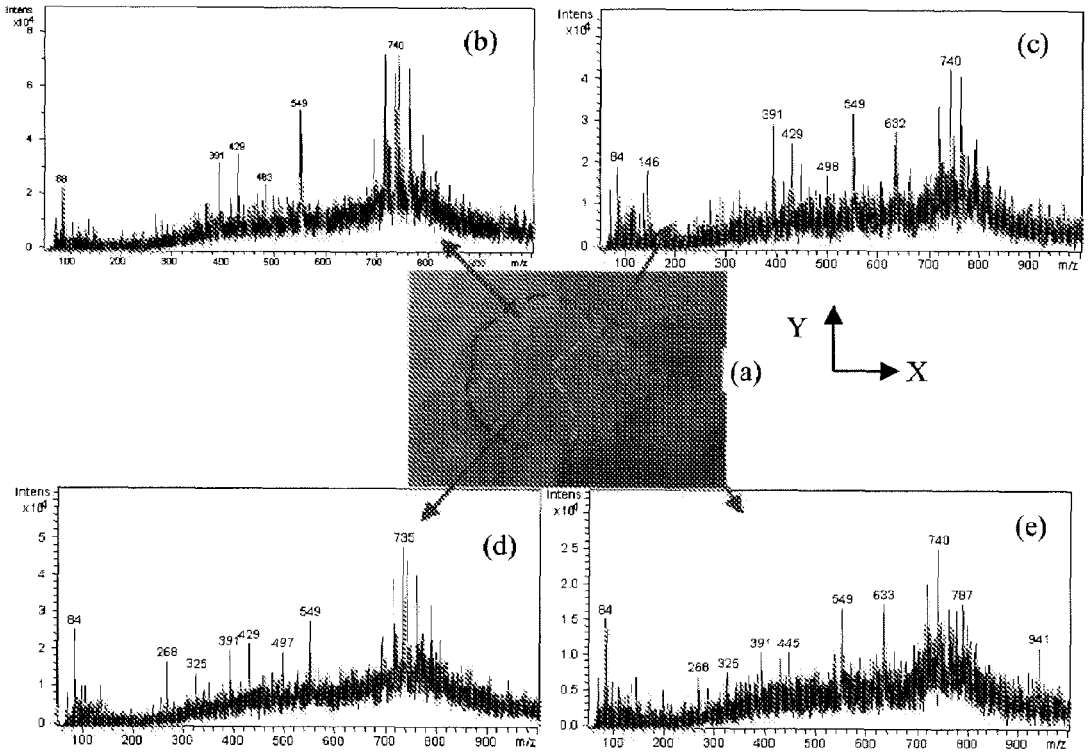
FIG. 12(*a*) is a diagram of a chicken brain slice obtained for conducting imaging mass spectrometric analysis in exemplary example 4.

Analysis using ELDI-MS on Chicken Brain As shown in FIG. 12(*a*), a slice of chicken brain measured 3 cm in length, 2 cm in width, and 15 μm in thickness was obtained for exemplary example 4 using the method of frozen section at −20° C. with Shadon Cryostat (Thermo Electron, San Jose, Calif.), where FIG. 12(*a*) shows a photograph of the chicken brain slice obtained. Prior to performing imaging mass spectrometric analysis using the above described procedure on the chicken brain slice, a saturated matrix solution commonly used in MALDI-MS, α-CHC (70% ACN, 0.1% TFA), was added evenly onto a surface of the chicken brain slice through 3 minutes of continued air spraying by an air-operated atomizer with 70 psi air pressure and 3 mL/hr solution flow rate. Imaging mass spectrometric analysis of the present invention was conducted on the matrix-added chicken brain slice upon drying thereof.

The sample stage 41 was moved relative to the laser beam 34 in the longitudinal direction (X) in the same manner as described above for exemplary example 1, such that two subsequent laser spots formed on the chicken brain slice in the longitudinal direction (X) are spaced apart from each other for 0.02 mm. The sample stage 41 was further moved in the transverse direction (Y) in consecutive increments of 1/30 cm upon control by the computer-controlled positioning mechanism 42. In other words, the laser beam 34 scans across the chicken brain slice in the longitudinal direction (X) for 60 times, each time at a different increment in the transverse direction (Y). In addition, since the mass spectra were obtained at a rate of one per second, each mass spectrum corresponds to an average of 10 corresponding successive laser spots that are formed on the chicken brain slice and that are altogether referred to as a scanned area of the chicken brain slice. Consequently, for each increment in the transverse direction (Y), 150 mass spectra were obtained. Moreover, a total of 9,000 mass spectra were obtained for the chicken brain slice.

Shown in FIGS. 12(*b*)~(*e*) are four mass spectra of the chicken brain slice obtained at various scanned areas thereof. A corresponding arrow is provided on FIG. 12(*a*) for each of FIGS. 12(*b*)~(*e*) to indicate the scanned areas of the chicken brain slice that corresponds to the corresponding mass spectrum. With reference to information recorded in relevant databases, an ion peak group with m/z values ranging approximately from 600 to 900 is found to be mainly composed of phosphatidylcholine (PC), which is a phospholipid.

Figure 13:
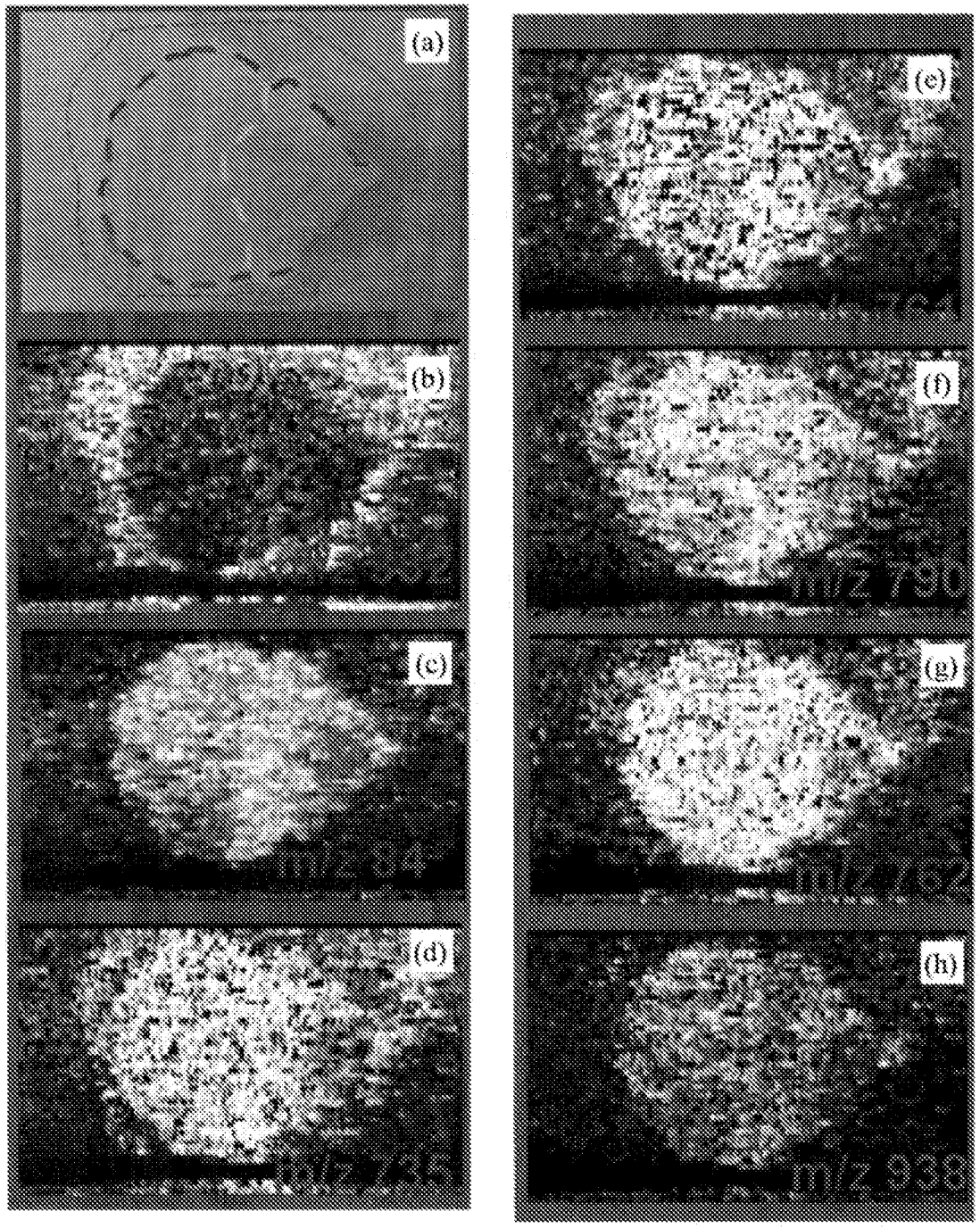
FIG. 13(*a*) illustrate a diagram of the chicken brain slice with an Optical Cutting Temperature (OCT) drug that surround the periphery of the chicken brain slice.
Figure 14:
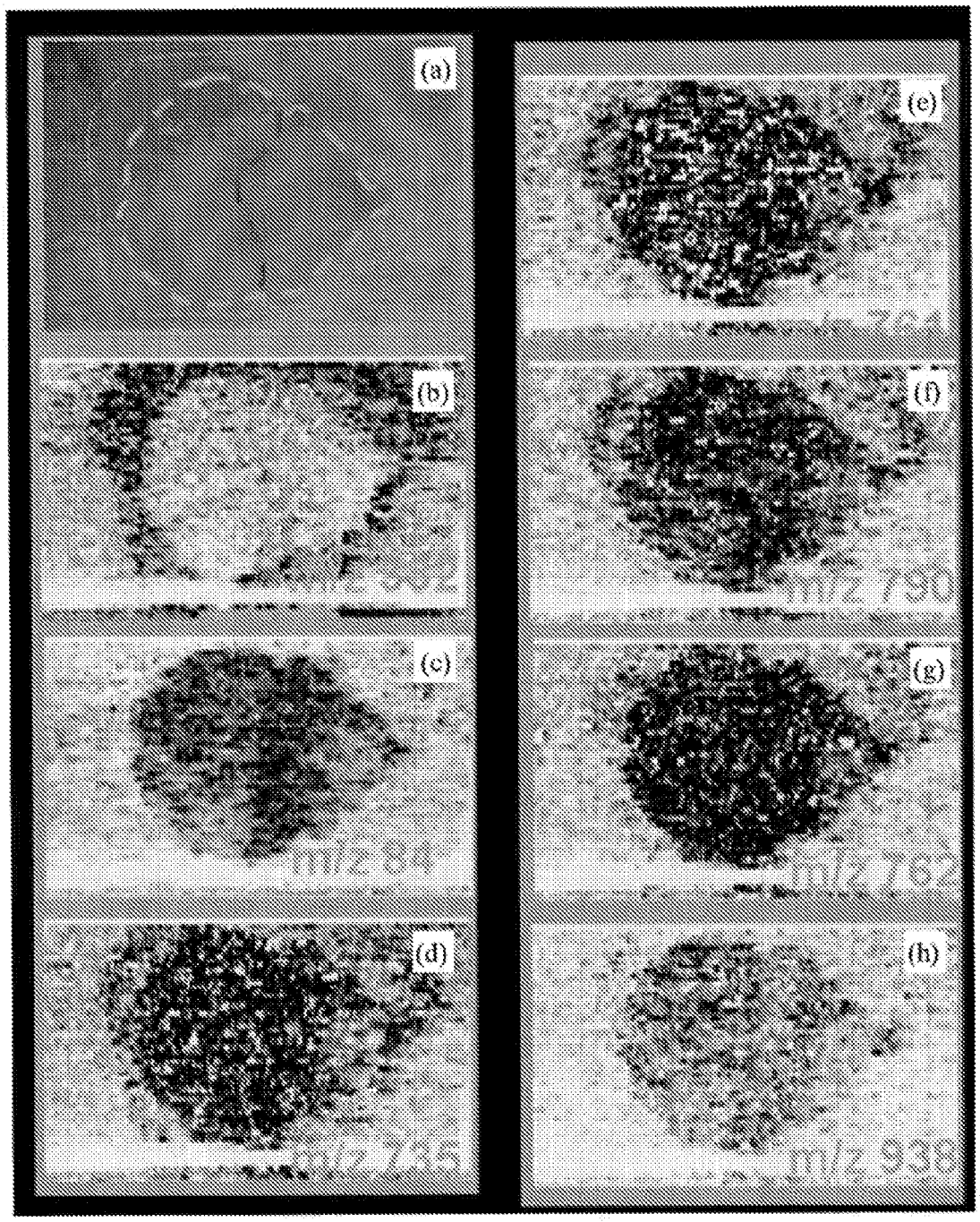
FIGS. 14(*a*)~(*h*) illustrate negative images of FIGS. 13(*a*)~(*h*), respectively, FIG. 15(*a*) illustrate a mass spectrum of a chicken heart slice, which is obtained for conducting imaging mass spectrometric analysis in exemplary example 5, at a location corresponding to fat surrounding an outer periphery of the chicken heart slice.

As shown in FIG. 13(*a*), an Optical Cutting Temperature (OCT) drug, a tissue freezing medium, for embedding/imbedding the chicken brain when preparing the frozen section, is shown to surround the periphery of the chicken brain slice. Shown in FIGS. 13(*b*)~(*h*) are a plurality of molecular imaging profiles constructed for the chicken brain slice at each of a plurality of representative m/z signals selected for the chicken brain slice and including m/z=332, m/z=84, m/z=735, m/z=761, m/z=790, m/z=762, and m/z=938. The OCT drug corresponds to the m/z=332 ion signal, and the molecular imaging profile obtained at m/z=332, as shown in FIG. 13(*b*), clearly shows the outline of the chicken brain slice, as the OCT ions mainly concentrate around the periphery of the chicken brain slice. It can be seen from the molecular imaging profiles corresponding to m/z=84, m/z=735, m/z=761, m/z=790, m/z=762, and m/z=938, which are chemical species contained in the chicken brain slice, that these chemical species are distributed relatively evenly throughout the chicken brain slice. FIGS. 13(*a*)~(*h*) show negative images of FIGS. 13(*b*)~(*h*), respectively.

EXEMPLARY EXAMPLE 5

Imaging Mass Spectrometric Analysis using ELDI-MS on Chicken Heart

Figure 16:
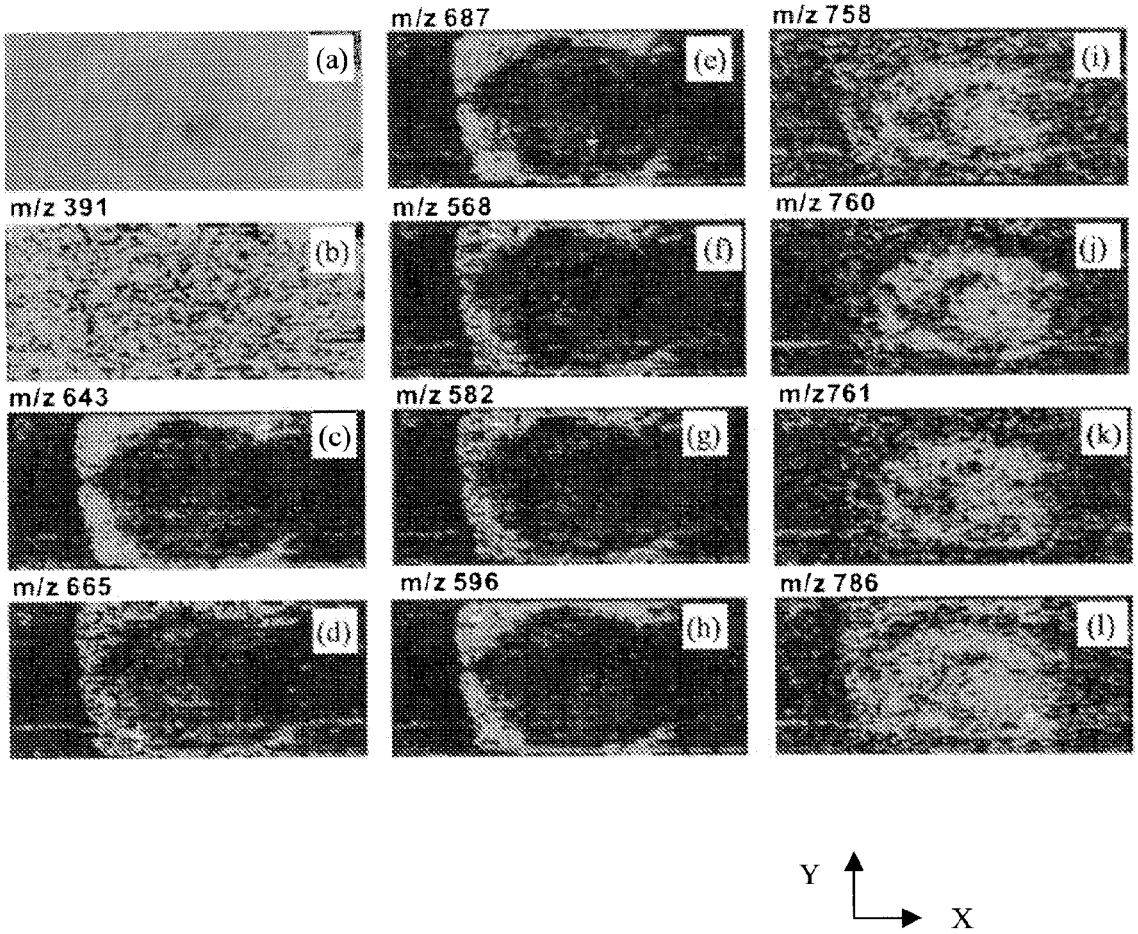
FIG. 16(*a*) illustrate a photograph of the chicken heart slice.

A chicken heart slice was obtained for exemplary example 5 using the method of frozen section at −20° C. with Shadon Cryostat (Thermo Electron, San Jose, Calif.) With reference to FIG. 16(*a*), the chicken heart slice was measured 25 mm in length, 18 mm in width, and 40 μm in thickness. Prior to performing imaging mass spectrometric analysis on the chicken heart slice, a saturated matrix solution, α-CHC (70% ACN, 0.1% TFA), was added evenly onto a surface thereof through 15 minutes of continued air spraying by an air-operated atomizer with 70 psi air pressure and 2.4 mL/hr solution flow rate.

The sample stage 41 was moved relative to the laser beam 34 in the longitudinal direction (X) in the same manner as described above for exemplary example 1, such that two subsequent laser spots formed on the chicken heart slice in the longitudinal direction (X) are spaced apart from each other for 0.02 mm. The sample stage 41 was further moved in the transverse direction (Y) in consecutive increments of 0.03 mm upon control by the computer-controlled positioning mechanism 42. In other words, the laser beam 34 scans across the chicken heart slice in the longitudinal direction (X) for 60 times, each time at a different increment in the transverse direction (Y). In addition, since the mass spectra were obtained at a rate of one per second, each mass spectrum corresponds to an average of 10 corresponding successive laser spots that are formed on the chicken heart slice and that are altogether referred to as a scanned area of the chicken heart slice. Consequently, for each increment in the transverse direction (Y), 125 mass spectra were obtained. Moreover, a total of 7,500 mass spectra were obtained for the chicken heart slice.

Figure 15:
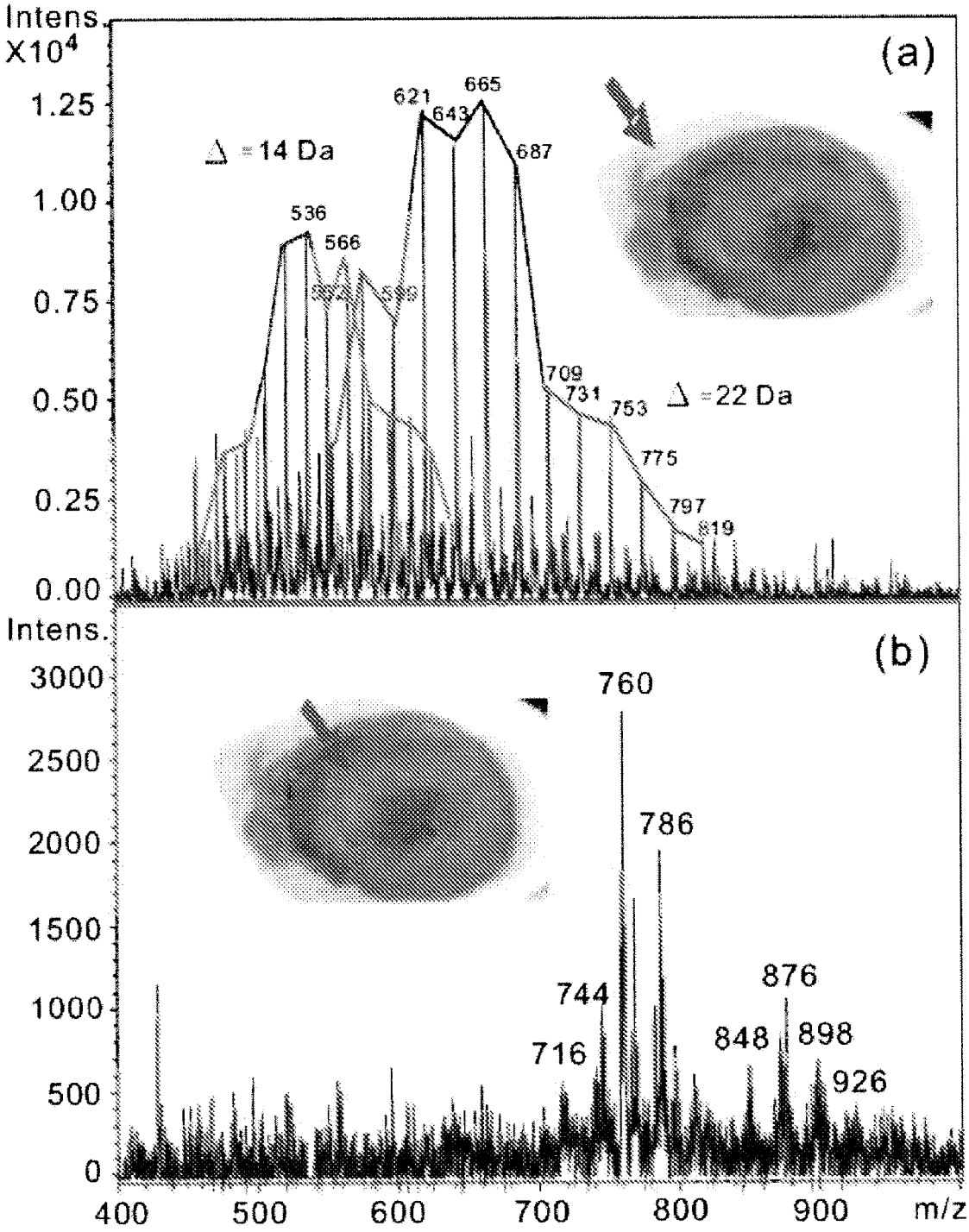
FIG. 15(*b*) illustrate a mass spectrum of the chicken heart slice at a location corresponding to muscle tissues at inner portions of the chicken heart slice.

Shown in FIG. 15(*a*) is a mass spectrum of the chicken heart slice obtained at the scanned areas corresponding to fat surrounding the outer periphery of the chicken heart slice, and pointed to by an arrow. This mass spectrum indicates two major ion peak groups that respectively correspond to two lipid groups with molecular weight differences of 14 Da and 22 Da, respectively. The m/z signals of the lipid ion peak groups that are selected as the representative m/z signals for the chicken heart slice include m/z=643, m/z=665, m/z=687, m/z=568, m/z=582, and m/z=596. Shown in FIG. 15(*b*) is a mass spectrum of the chicken heart slice obtained at the scanned area corresponding to muscle tissues at the inner portions of the chicken heart slice, and pointed to by an arrow. This mass spectrum indicates a major ion peak group that corresponds to phosphatidylcholine (PC). The m/z signals of the PC ion peak group that are selected as the representative m/z signals for the chicken heart slice include m/z=758, m/z=760, m/z=761, m/z=768.

Figure 17:
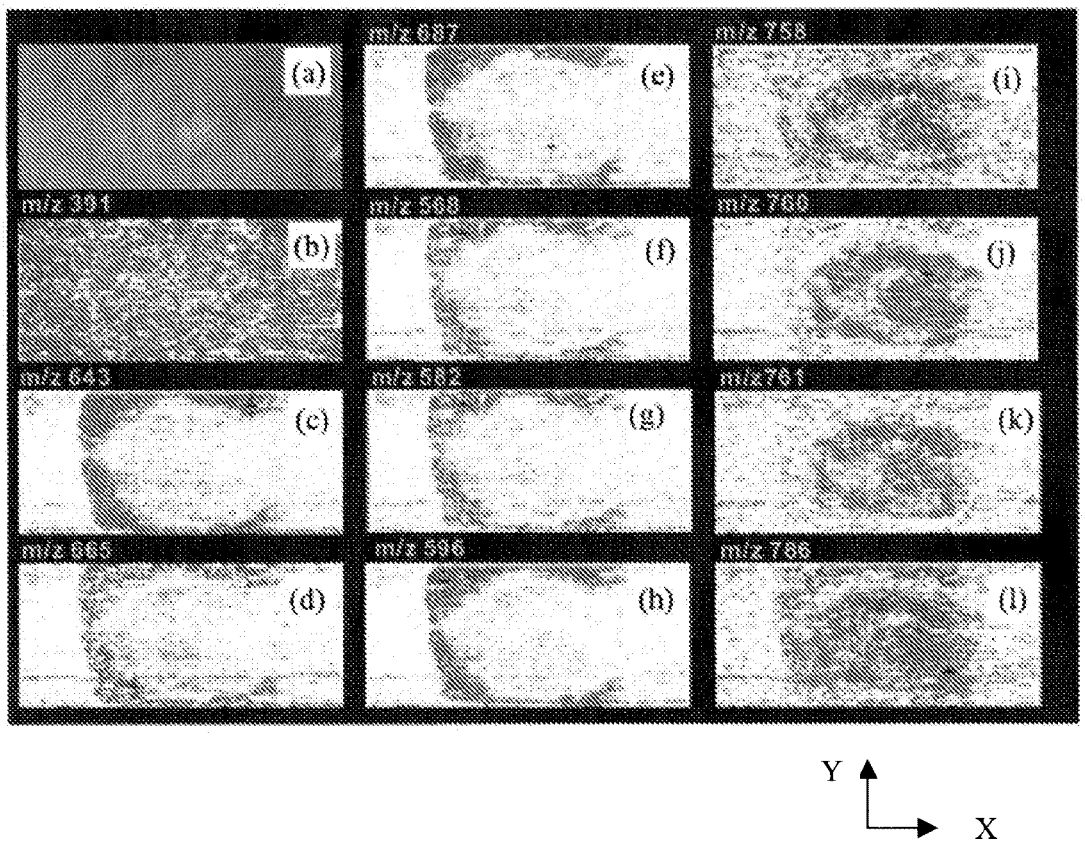
FIGS. 17(*a*)-(*l*) illustrates negative images of FIGS. 16(*a*)-(*l*), respectively.

Shown in FIG. 16(*b*) is a molecular imaging profile constructed for the chicken heart slice at a m/z=391 background ion signal. Shown in FIGS. 16(*c*)~(*e*) are molecular imaging profiles constructed for the chicken heart slice at the lipid representative m/z signals of the 22 Da-molecular-weight-difference group. Shown in FIGS. 16(*f*)~(*h*) are molecular imaging profiles constructed for the chicken heart slice at the lipid representative m/z signals of the 14 Da-molecular-weight-difference group. Further, shown in FIGS. 16(*i*)~(*m*) are molecular imaging profiles constructed for the chicken heart slice at the PC representative m/z signals. FIG. 17(*a*)~(*m*) illustrate corresponding negative images of FIG. 16(*a*)~(*m*), respectively.

With reference to the results described hereinabove with respect to the exemplary examples, it is evident that the mass spectrometric imaging method using electrospray laser assisted desorption mass spectrometry according to the present invention has the ability to detect molecules contained in a solid sample, such as fungus, a plant tissue, an animal tissue, etc. Since the sample is irradiated by a laser beam, which forms a laser spot thereon, and since the sample can be maneuvered to swiftly move relative to the laser beam, the sample can be scanned by the laser beam such that irradiations of various areas thereof by the laser beam can be completed within a desirable short period of time, so as to obtain a sufficiently great number of mass spectra respectively corresponding to the scanned areas of the sample to thereby ensure that a highly accurate molecular imaging profile of the sample be obtained.

In addition, by integrating the results from all of the mass spectra, spatial distribution profiles of the molecules contained in the sample can be generated. More particularly, based on the intensities at a selected representative mass-to-charge ratio (m/z) signal displayed by a plurality of scanned areas of the sample, a molecular imaging profile can be constructed to portray the spatial distribution of a particular analyte (molecule) that corresponds to the representative m/z signal. Even volatile molecules, such as odorous smaller molecules, emitted from a tissue surface can be detected, and a molecular imaging profile thereof can also be constructed.

In sum, the mass spectrometric imaging method under ambient conditions using electrospray assisted laser desorption ionization mass spectrometry according to the present invention is capable of conducting imaging mass spectrometric analysis directly on solid samples. Molecules including non-polar molecules (e.g., triterpenoids), volatile molecules (e.g., aromatic micro-molecules), non-volatile molecules (e.g., lipids) can be detected by the present invention, and molecular imaging profiles thereof can also be constructed. Consequently, the present invention can be applied to various fields, is beneficial to basic medical science with respect to the understanding of the spatial distribution of molecules in various organs and tissues, and is especially advantageous in the diagnosis of diseases, and the discrimination between normal and abnormal tissues.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A mass spectrometric imaging method comprising the steps of:

forcing sequentially generated charge-laden liquid drops to move from a nozzle towards a receiving unit of a mass spectrometer along a traveling path defined in a longitudinal direction between the nozzle and the receiving unit;

scanning a sample with a laser beam which has an irradiation energy sufficient to cause analytes contained in said sample to be desorbed to fly along a plurality of flying paths respectively; and positioning said sample relative to said laser beam to render said plurality of flying paths intersecting said traveling path so as to permit a plurality of said analytes respectively along said plurality of flying paths to be occluded in a plurality of said charge-laden liquid drops respectively to thereby form a plurality of corresponding ionized analytes.

2. The mass spectrometric imaging method according to claim 1, wherein said sample has a self-sustained shape.

3. The mass spectrometric imaging method according to claim 2, wherein in the step of scanning, said laser beam is kept to irradiate along a predetermined line, and said sample is placed on a sample stage which is disposed to be movable relative to said laser beam.

4. The mass spectrometric imaging method according to claim 3, wherein said laser beam is transmitted through a fiber optic unit.

5. The mass spectrometric imaging method according to claim 4, further comprising the step of obtaining a plurality of mass spectra respectively for a plurality of Scanned areas of said sample though analyzing said plurality of corresponding ionized analytes which respectively correspond to said plurality of scanned areas of said sample.

6. The mass spectrometric imaging method according to claim 5, further comprising the step of selecting at least one representative mass-to-charge ratio (m/z) signal which may signify a characteristic of said sample from said plurality of mass spectra.

7. The mass spectrometric imaging method according to claim 6, further comprising the step of constructing an imaging profile for said sample based on intensities at each of said at least one representative mass-to-charge ratio signal displayed by said plurality of scanned areas.

8. A mass spectrometric system which is capable of obtaining an imaging profile, and which includes a mass spectrometer for analyzing ionized analytes, said mass spectrometric system comprising:

a receiving unit for the mass spectrometer;

means for forcing sequentially generated charge-laden liquid drops to move from a nozzle towards said receiving unit along a traveling path defined in a longitudinal direction between the nozzle and the receiving unit;

means for scanning a sample with a laser beam which has an irradiation energy sufficient to cause analytes contained in said sample to be desorbed to fly along a plurality of flying paths respectively; and means for positioning said sample relative to said laser beam to render said plurality of flying paths intersecting said traveling path so as to permit a plurality of said analytes respectively along said plurality of flying paths to be occluded in a plurality of said charge-laden liquid drops respectively to thereby form a plurality of corresponding ionized analytes.

* * * * *